US007296634B2

(12) United States Patent
MacDonald, III et al.

(10) Patent No.: US 7,296,634 B2
(45) **Date of Patent: *Nov. 20, 2007**

(54) DECORATIVE SUPPORT PANEL

(75) Inventors: Norman J. MacDonald, III, Lunenberg, MA (US); Peter M. MacDonald, Sherborn, MA (US); Paul S. F. Silcox, Plainville, MA (US)

(73) Assignee: PBJ, LLC, Holliston, MA (US)

( * ) Notice: Subject to any disclaimer, the term of this patent is extended or adjusted under 35 U.S.C. 154(b) by 132 days.

This patent is subject to a terminal disclaimer.

(21) Appl. No.: 11/125,618

(22) Filed: May 9, 2005

(65) Prior Publication Data

US 2005/0194153 A1 Sep. 8, 2005

Related U.S. Application Data

(63) Continuation of application No. 10/214,925, filed on Aug. 7, 2002, now Pat. No. 6,907,938.

(51) Int. Cl.
*A62C 2/00* (2006.01)

(52) U.S. Cl. ..... 169/43; 169/16; 169/37; 169/46; 169/54; 239/208; 239/289; 239/588; 52/39; 52/506.07; 248/56; 248/75; 248/343

(58) Field of Classification Search ..... 169/16, 169/37, 54, 43, 46; 239/208, 289, 588; 248/56, 248/57, 59, 71, 75, 317, 342, 343; 428/174, 428/187, 920; 52/39, 144, 506.06, 506.07
See application file for complete search history.

(56) References Cited

U.S. PATENT DOCUMENTS

| | | | | |
|---|---|---|---|---|
| 3,685,235 | A * | 8/1972 | Lang | 52/506.06 |
| 3,703,307 | A * | 11/1972 | Curtis | 52/506.07 |
| 4,007,878 | A * | 2/1977 | Anderson | 239/209 |
| 4,019,582 | A * | 4/1977 | Gangell | 169/37 |
| 5,699,641 | A * | 12/1997 | Tinen et al. | 52/506.07 |
| 6,484,809 | B1 * | 11/2002 | Elder | 169/37 |

* cited by examiner

*Primary Examiner*—Steven J. Ganey
(74) *Attorney, Agent, or Firm*—Occhiuti Rohlicek & Tsao LLP

(57) ABSTRACT

The invention features an apparatus and method for positioning and supporting a sprinkler head in a ceiling, floor, or wall. In one aspect of the invention, a sprinkler head may be received by a sleeve extending through a broad surface of the plate. The plate may be configured to be removably attached to a support structure in the ceiling, floor, or wall and having an exterior surface exposed to the room or the plate may be attached to a decorative panel which is configured to be removably attached to a support structure in the ceiling, floor, or wall and having an exterior surface exposed to the room. The sleeve may be defined by an opening in the plate or it may be a separate structure permanently or removably attached to the plate.

71 Claims, 8 Drawing Sheets

DECORATIVE SUPPORT PANEL

This application is a continuation (and claims the benefit of priority under 35 USC 120) of U.S. application Ser. No. 10/214,925, filed Aug. 7, 2002 now U.S. Pat. No. 6,907,938.

TECHNICAL FIELD

This invention relates to a fire protection sprinkler head support system.

BACKGROUND

A typical automatic fire sprinkler system includes a network of pipes that carry a fire suppression fluid, e.g., water, to each room in the building. Conduit sections carry the fluid from the pipes to sprinkler heads strategically located in different rooms. The position and orientation of each sprinkler head is typically maintained in place by a support mechanism. When the room reaches an elevated temperature due to a fire, the sprinkler head is activated allowing a stream of fire suppression fluid to be directed over the intended area of coverage. During operation, the fluid pressure at each sprinkler head can reach significant levels of pressure (e.g., 175 psi), generating substantial back pressure on the sprinkler head's support system. The support mechanism must be capable of holding the sprinkler head securely in place during operation. Flexible fire protection sprinkler systems are described in U.S. Pat. No. 6,076,608 and U.S. Pat. No. 6,123,154, both of which are incorporated herein by reference.

SUMMARY

The invention features an apparatus and method for positioning and supporting a sprinkler head in a ceiling, floor, or wall.

According to one aspect of the invention, the invention features a panel attached to a hub. The hub includes a plate attached to the panel and a sleeve defining an opening extending through the broad surface of the plate. The sleeve is configured to receive the sprinkler head through the opening.

In another aspect, the invention features a plate having an exterior surface exposed to the room and a sleeve defining an opening extending through the broad surface of the plate. The sleeve is configured to receive the sprinkler head through the opening.

In yet another aspect, the invention features a plate attached to a decorative panel attached to the plate. The plate is configured to attach to the sprinkler head and the decorative panel includes an exterior surface exposed to the room and having a hole and configured to receive the sprinkler head therethrough.

One or more of the following features may be included: The plate may have a hole configured to the receive the sprinkler head therethrough. The apparatus may also include a sleeve permanently or removably attached to the plate and defining an opening extending through the broad surface of the plate, the sleeve configured to receive the sprinkler head through the opening.

The plate may be permanently or removably attached to the panel and may be attached to the panel with a fastener. The plate may also be laminated to the panel or at least partially integrated within the panel.

The panel may have a length L and a width W and the plate has a length and width substantially equal to L and W, respectively. The plate may be in the shape of a ring having a thickness T and an inner diameter R1 and an outer diameter R2 and the sleeve is defined by the opening of the plate.

The panel may have a certain rigidity characteristic and the plate may have a rigidity characteristic that is greater than the rigidity characteristic of the panel. The panel may be formed from PVC and the plate may be formed from stainless steel.

The plate may have a hole extending through its broad surface and the sleeve may be defined by the hole in the plate. The sleeve may be a separate structure from the plate that is permanently or removably attached to the plate. The sleeve may be a telescoping sleeve which is configured to open to receive a sprinkler head and closed to secure the sprinkler head in plate. The plate may define a channel sized to slidably receive the sprinkler head. Additionally, the plate may include a plurality of sleeves, each of which are configured to receive a sprinkler head.

The invention may also include one or more attachment members, each having a first end attached to the plate and a second end configured to engage the support structure in the ceiling, floor, or wall. The second end of the attachment members may include a foot to engage the support structure, the second end of the attachment members may also include a fastening device to attached to the support structure. One or more of the attachment member may be at least partially integrated within the decorative panel and angled relative to the plate. The attachment members may be in the form of legs.

The plate may include a first and second plate section and the sleeve may include a first sleeve section attached to the first plate section, and the first plate section may be removably attached to second plate section.

The invention may also include one or more brackets, each having a first and second surface. The first surface of each bracket may be permanently or removably attached to the plate and the second surface of each bracket may be permanently or removably attached to the panel.

The invention may also include a flexible sprinkler assembly permanently or releasably attached to the sleeve. The flexible sprinkler assembly may include a flexible conduit, a fitting attached to the flexible conduit, and a sprinkler head attached to the fitting. The flexible sprinkler assembly may be attached to supply pipes. The sleeve may be integral to the sprinkler head and the height of the sprinkler head may be adjusted within the sleeve.

The invention may also include a rod having a first end attached to the hub and a second end adapted to be attached to the ceiling, floor, or wall.

The panel may be configured to be inserted into a plurality of support members forming a suspended ceiling.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
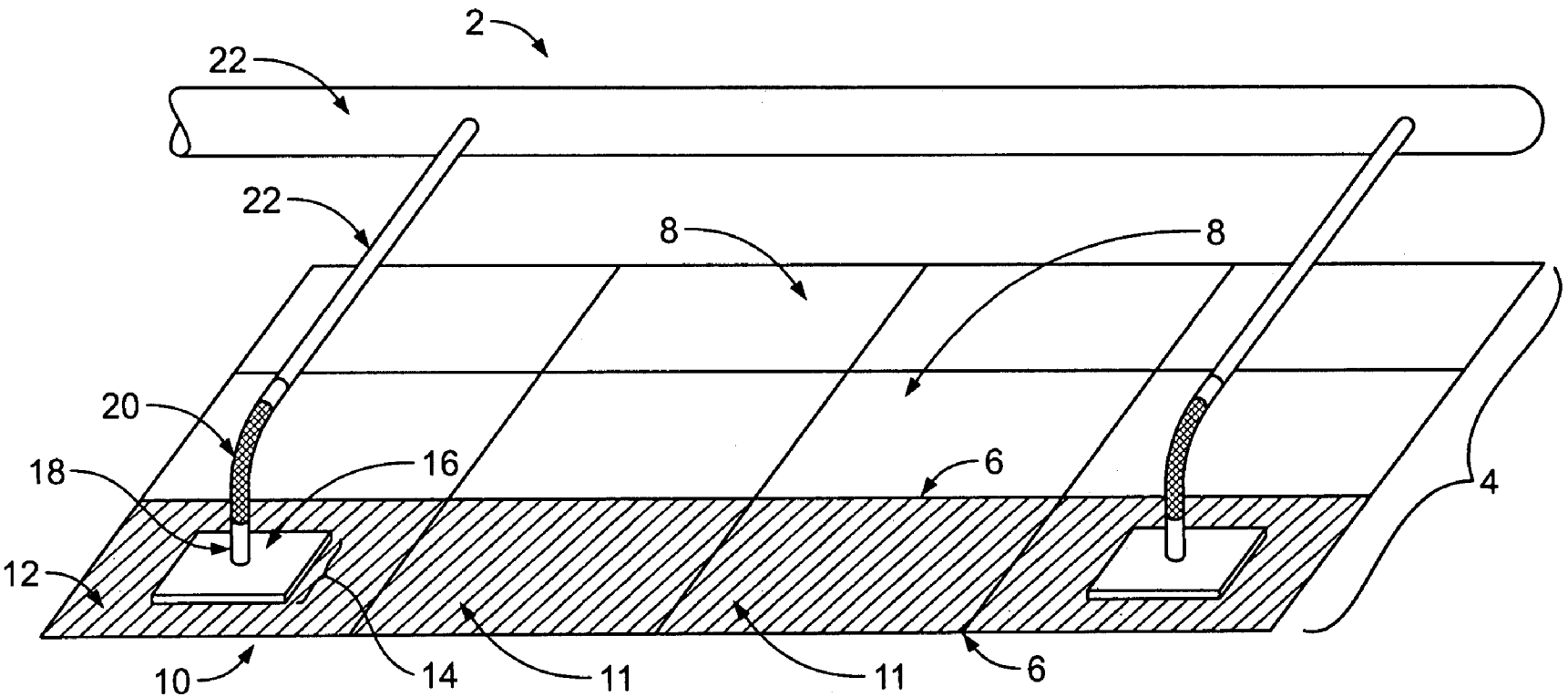
FIG. 1 is a perspective view of two sprinkler support panels, positioned within a suspended ceiling.

Referring to FIG. 1, a sprinkler system 2 includes two decorative support panels 10 mounted within a ceiling 4 having a ceiling frame 6 and an array of rectangular frame sections 8. The array of rectangular frame sections 8 support the decorative support panels 10 as well as an array of decorative ceiling panels 11.

As will be described in greater detail below, each decorative support panel 10 includes a decorative panel 12 and a hub 14. Hub 14 further includes a plate 16 and a sleeve 18 and is configured to receive a sprinkler head 42 (shown in FIG. 3). Decorative support panel 10 secures sprinkler head 42 at a predetermined position within one of the rectangular frame sections 8. A flexible conduit 20 carries a fire suppression fluid, e.g., water, from supply pipes 22 to sprinkler head 42. Pipes 22 can be part of a fluid delivery system dedicated to fire suppression or can also deliver water to other functions (e.g., a water faucet, toilet, dishwasher, etc.). When the room reaches elevated temperatures, sprinkler head 42 is activated and a stream of fire suppression fluid is directed into the room to extinguish the fire.

In order to function effectively, sprinkler head 42 must be held firmly in place during operation. Due to the significant back pressure of the fluid flowing through the sprinkler head during operation, sprinkler head 42 is subjected to significant side, rotational, and torsional forces, which are capable of changing the position of the sprinkler head 42, thereby causing the fluid to be directed away from the intended target. During operation, the decorative support panel 10 is configured to resist movement of sprinkler head 42 by distributing the forces to the four edges of decorative panel 12 which, in turn, are distributed to the ceiling frame 6.

The underside (i.e., the side exposed to the room) of decorative panel 12 may be designed to match adjacent decorative ceiling tiles 11 in order to present an aesthetically pleasing appearance in the room. Additionally, decorative panel 12 may be formed from materials commonly used to make standard decorative ceiling panels such as softboard, wood fiber composite, polymers, melamine foam, or fibrous plaster.

Figure 2:
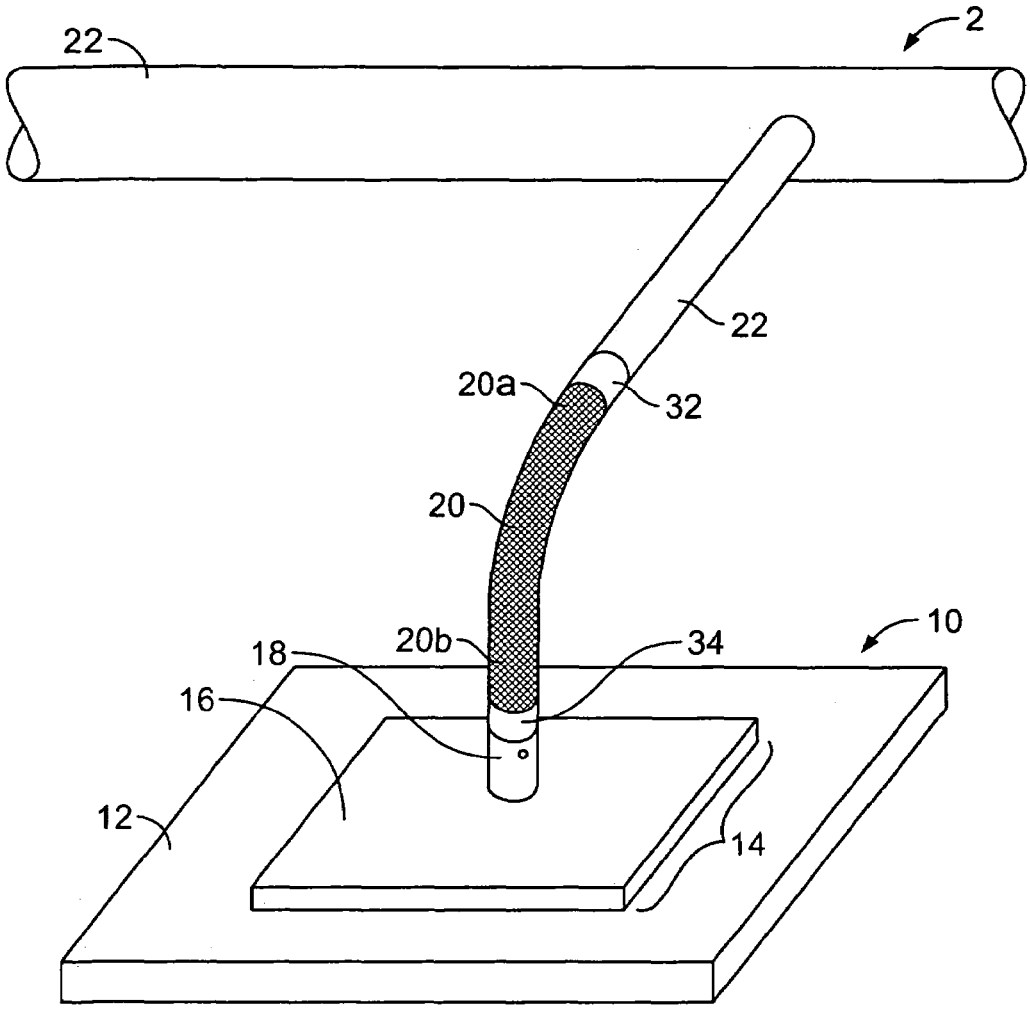
FIG. 2 is a perspective view of one of the sprinkler support panels of FIG. 1.

Referring to FIG. 2, in a sprinkler system 2, a length of flexible conduit 20 is located between a pipe 22 and a decorative support panel 10. One end 20*a* of flexible conduit 20 is attached to pipe 22 by a fitting 32. Fitting 32 can be any one or more commonly known methods of connecting to pipe, including, for example, threaded, grooved, socket welded, socket glued, regular welded, pressed fit, compression fitting, or a flare fitting connection. In addition, an adaptor (not shown) can be used to attach fitting 32 to flexible conduit 20. The method selected for fitting 32 will depend on the material used for conduit 20 and the type of fire suppression fluid using in the sprinkler system. Fitting 32 can be made of any material, but the material will also generally depend on the material used for the conduit 20 and the type of fire suppression fluid used in sprinkler system 2.

A second end 20*b* of flexible conduit 20 is attached to a fitting 34 which is, in turn, attached to sprinkler head 42 (shown in FIG. 3) by any of the above methods. As with fitting 32, the type of connection and the material used for fitting 34 can depend on the material used for conduit 20 and fire suppression fluid. Fitting 34 can be a rigid, substantially cylindrical tube such as a reducing fitting.

Figure 3:
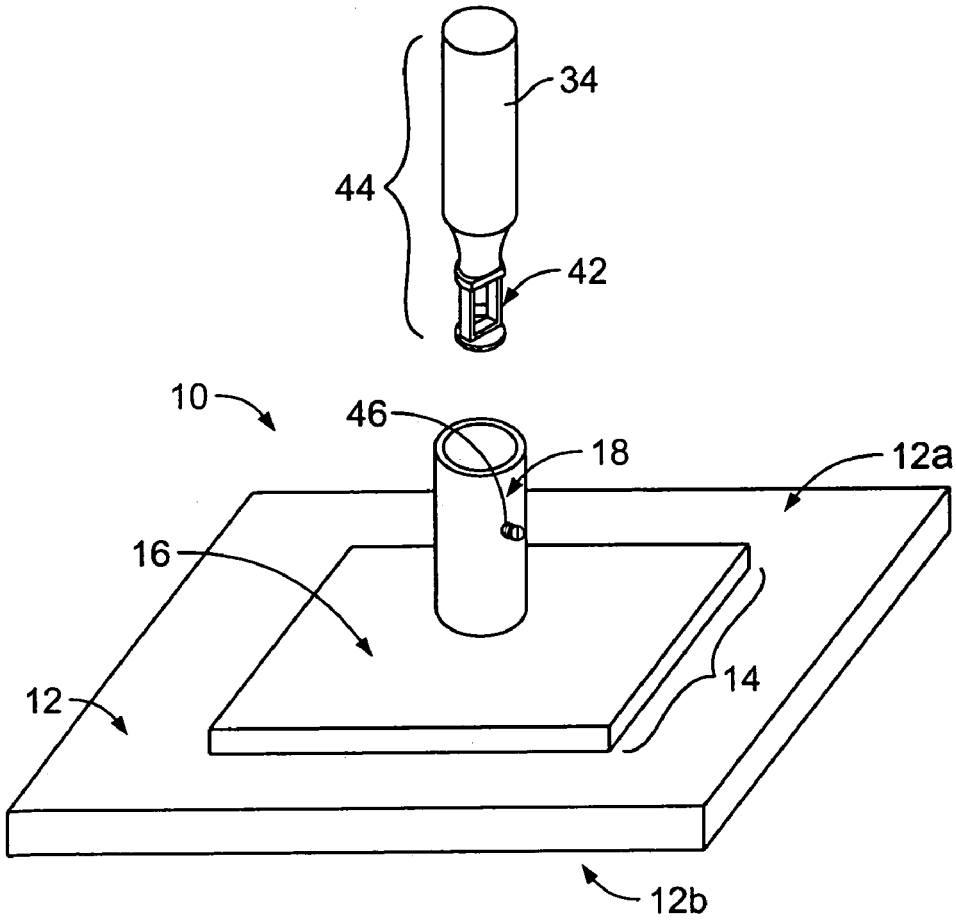
FIG. 3 is a perspective view of a sprinkler support panel receiving a sprinkler head assembly.

Referring to FIG. 3, decorative support panel 10 includes a decorative panel 12 and a hub 14. Hub 14 further includes a sleeve 18 and a plate 16.

Hub 14 is mounted to the decorative panel 12 such that it will remain attached to the decorative panel during operation in a high temperature environment. In FIG. 2, plate 16 is laminated to decorative panel 12, however, it may be mounted to decorative panel 12 in a number of ways, including by glue, adhesive, cement, bolts, screws, or a combination of these. Additionally, the decorative panel 12 may be formed (e.g., by injection molding) partially or completely around the plate 16.

Hub 14 may be formed from any rigid material capable of withstanding high temperature environments likely to be experienced in a fire such as steel, steel alloy, iron, aluminum, titanium, copper, ceramic, ceramic composite, or high temperature plastic.

Figure 9:
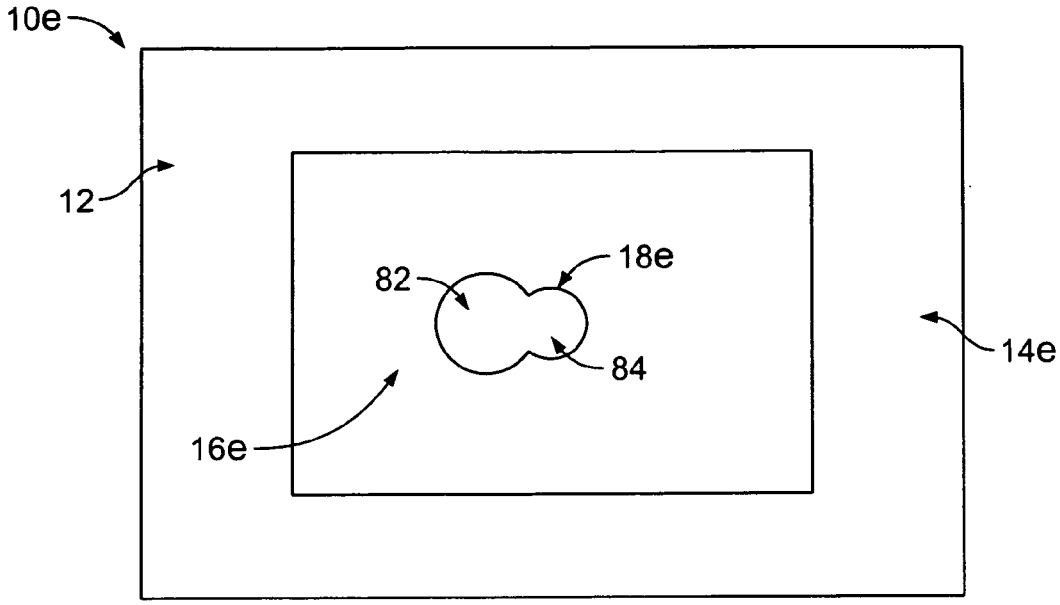
FIG. 9 is a top view of another sprinkler support panel having a sliding slot sleeve for receiving a sprinkler head.

Sleeve 18 of hub 14 is secured to plate 16*a* and is adapted to receive sprinkler head 32. Sleeve 18 may be secured to plate 16 either permanently or removably using a number of commonly known methods including, for example, welds, glue, adhesive, cement, rivets, bolts, screws, clips, pins, a sliding slot (as illustrated in FIG. 9), or any combination of these. Additionally, sleeve 18 and plate 16 may formed of a single-piece construction by, for example, injection molding hub 14.

Sprinkler head 42 and fitting 34 form a sprinkler head assembly 44. The sprinkler head assembly 44 fits into sleeve 18 and is removably secured by set screw 46. Sprinkler head assembly 44 may also include a series of grooves on its outer surface to receive set screw 46 which would further secure sprinkler head assembly 44 within sleeve 18. The inner diameter of sleeve 18 should be only slightly larger than the outer diameter of sprinkler head assembly 44 in order to reduce the ability of sprinkler head assembly 44 to move within sleeve 18 during operation. Using a set screw 46 allows the height of sprinkler head assembly 44 to be adjusted relative to the bottom surface of the decorative panel 12*b* while also functioning to secure sprinkler head assembly 44 in place. While the use of a set screw is illustrated in FIG. 3, many other commonly known methods may be used to removably secure sprinkler head assembly 44 within sleeve 18, such as bolts, clips, pins, and the like. Additionally, sprinkler head 42 may be secured to sleeve 18 by configuring sleeve 18 as a telescoping sleeve. In this embodiment, the telescoping sleeve is rotated in one direction to open its center. While open, sprinkler head 42 is inserted and positioned to the proper height. Once sprinkler head 42 is in place telescoping sleeve is rotated in the opposite direction to close it and fasten sprinkler head 42 in place.

Figure 4:
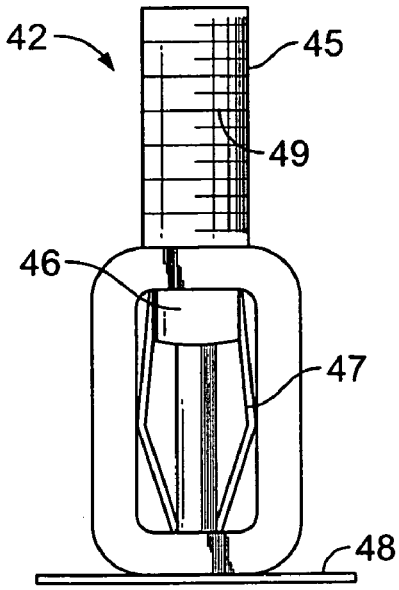
FIG. 4 is a side view of a sprinkler head.

Sprinkler head 42 can be any of the sprinkler head designs commonly used in the fire protection industry. For example, with reference to FIG. 4, sprinkler head 42 includes a length of cylindrical pipe 45 having a fluid passage obstructed by a plug 46. Plug 46 is held in place by fusible links 47, which are fabricated to melt within a specific temperature range, e.g., between 130° F. and 212° F.

Alternative methods of holding plug 46 in place include a bottle of glycerin that expands when heated to break the vile. When links 47 break, plug 46 is released from pipe 45 by the pressure of the sprinkler system fluid, and the fluid is scattered over a wide area by a dispersion device 48. The outer surface of pipe 45 includes threads 49 for connection to a fitting.

In certain situations, a support structure, such as the suspended ceiling 4 shown in FIG. 1, can either fail, that is, fall down, or may be removed during renovations or repairs. For example, during a fire or an earthquake all or parts of ceiling frame 6 can collapse. Similarly, a crew removing ceiling frame 6 during renovations may not always take care to separate the sprinkler system from the decorative support panel 10 before it is torn down. In addition, if it is suspected that a fire is located above a suspended ceiling, a suspended ceiling may be torn down. Also, local codes may require that the sprinkler system continue to operate when the ceiling is tom down.

In these situations, if the sprinkler heads are solely supported by a decorative support panel 10 inserted in a ceiling frame 6, then the sprinkler head support system will likely fail when the ceiling frame 6 is torn down. This could result in significant damage to the sprinkler system as well as damage to building due to water leaks. Moreover, if, due to this damage, sprinkler system 2 fails to operate during a fire or an earthquake the building may be destroyed.

A sprinkler system 2 will likely not be damaged or fail to operate if a support system includes an auxiliary support mechanism such as a rod, chain, wire, or rope attached to a building component.

Figure 5:
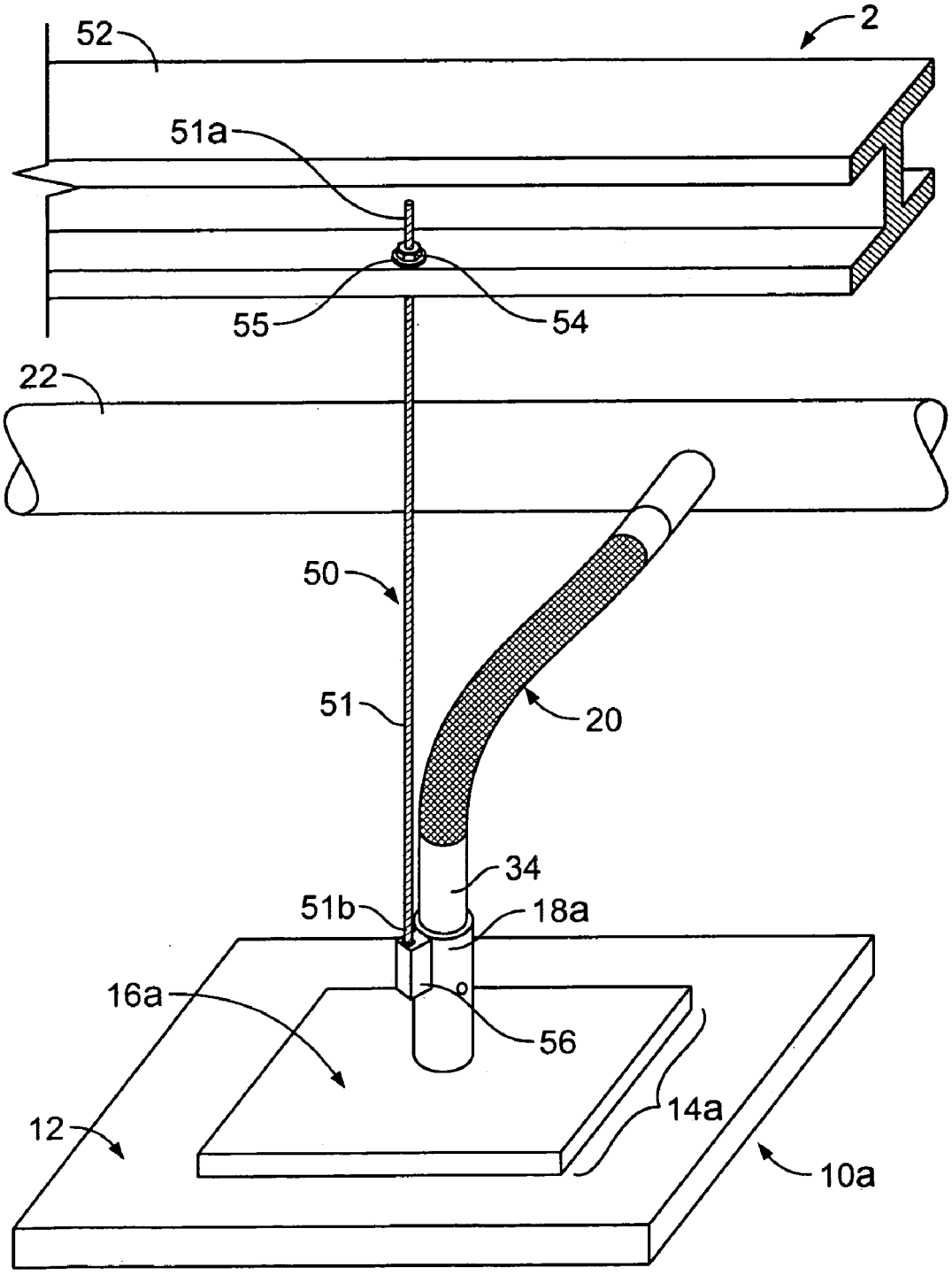
FIG. 5 is perspective view of a primary and auxiliary sprinkler head support system.

For example, as shown in FIG. 5, sprinkler system 2 can include a primary support system and an auxiliary support system 50. Primary support system includes a decorative support panel 10*a*. Auxiliary support system 50 includes a rod 51 attached between the sleeve 18 and a building component 52. Rod 51 is designed to perform two functions. First, rod 51 helps to hold sprinkler head 42 (not shown in FIG. 6) in place by resisting the back pressure and twisting forces generated during sprinkler head operation. Second, in the event of support structure failure, as described above, the sprinkler head 42 (and decorative support panel 10*a*), will hang from rod 51, enabling sprinkler head 42 to remain in position and continue to provide fire protection.

To provide these advantages, an upper portion 51*a* of rod 51 is connected to a building component, e.g., an I-beam 52, by a washer 55 and nut 54. A lower portion 51*b* of rod 51 is connected to the hub 14 by screwing a portion of the lower portion 51*b* of the rod 51 into a threaded hole drilled into a mounting block 56 attached to the sleeve 18*a*.

Rod 51 can be attached to sleeve 18*a*, plate 16*a*, or directly onto the sprinkler head assembly 44 by welding, bolting, clipping, or by screwing rod 50 into a threaded hole (as shown in FIG. 5), or by any other commonly known attachment mechanism.

Rod 51 can be threaded or non-threaded and can be constructed from numerous materials, including but not limited to stainless steel, other steels, rubbers, plastics, polymers, ferrous metals, non ferrous metals, polycarbonates, or any combination thereof.

Alternatives to using a rod 51 in an auxiliary support system 50 include a chain, wire or rope, all of which can be attached to the hub 14 or sprinkler head assembly 44. These devices will similarly prevent the sprinkler head assembly 44 and decorative support panel 10 from falling during support structure failure. Further, in locations that experience frequent seismic events, a rod will transmit any shocks or vibrations directly from the building component to the support system. The more flexible devices will cushion the vibrations. However, flexible secondary support devices such as chains, wires, or ropes may not alone provide adequate support for the sprinkler head assembly during operation.

Figure 6:
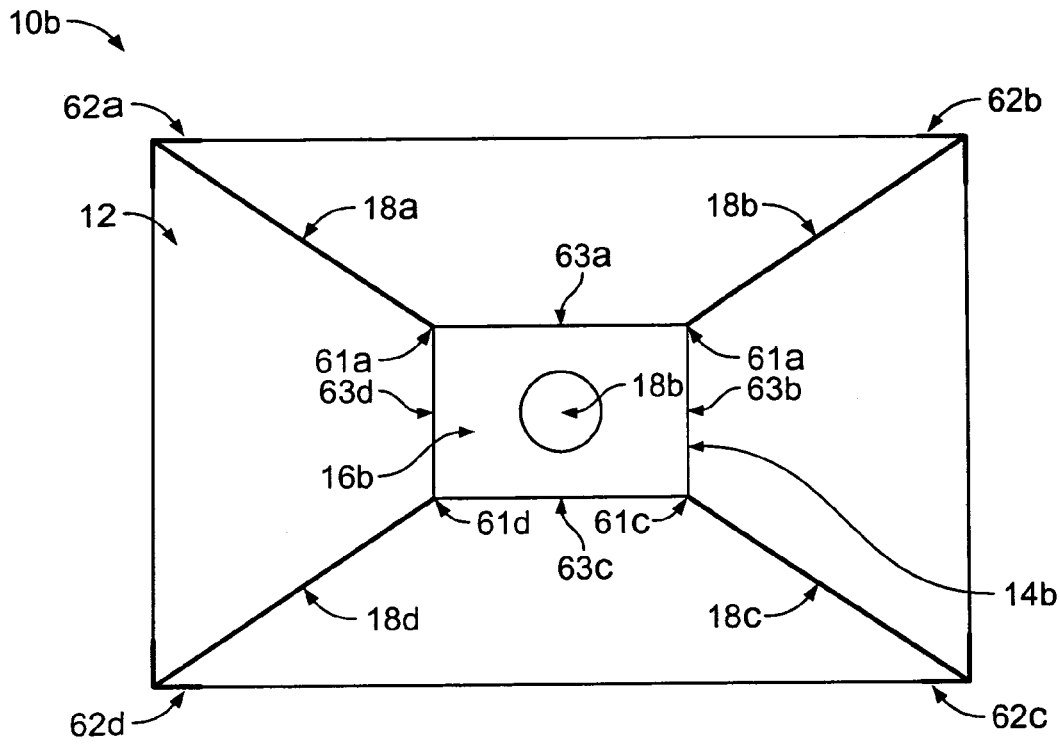
FIG. 6 is a top view of another sprinkler support panel having four support legs.

As shown in FIG. 6, another decorative support panel 10*b* is shown with four support legs, 60*a*-60*d*. These support legs are formed from a rigid material able to maintain their rigidity in high temperature environments that would be present during a fire. The support legs are attached, e.g., by welding, to plate 16*b* of hub 14*b*. Each of the support legs, 60*a*-60*d*, extend from one of the four corners 61*a*-61*d* of plate 16*b* to the corresponding corners of decorative panel 12. Additionally, each of the support legs, 60*a*-60*d*, include an angled foot 62*a*-62*d* which is configured to engage the ceiling frame 6 (shown in FIG. 1). During operation of the sprinkler head, support legs 60*a*-60*d* help to transfer forces caused by the back pressure to ceiling frame 6. The support legs 60*a*-60*d* are substantially parallel with the plane of decorative panel 12 and are on the back surface of decorative panel 12. However, in other separate embodiments, the support legs may be angled relative to the plane of the decorative or they may be completely or partially integrated within the decorative panel. Additionally, clips (not shown) may be attached between the ceiling frame 6 and the feet of the support legs 61*a*-61*d* in order further attach the decorative support panel to the ceiling frame 6. In another embodiment, support legs, 60*a*-60*d*, may extend from each of the side edges 63*a*-63*d* of the plate 16*b* to the corresponding side edge of decorative panel 12.

Figure 7:
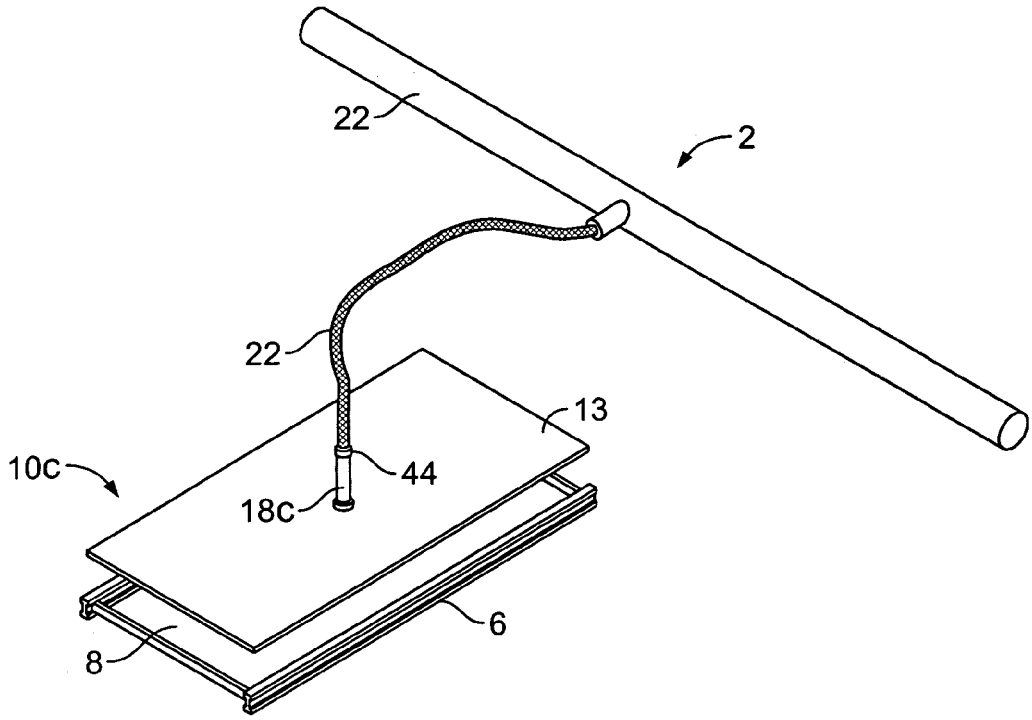
FIG. 7. is a perspective view of another sprinkler support panel having an integrated decorative panel and hub.

As shown in FIG. 7, an additional embodiment of a decorative support panel 10*c* is shown. In this embodiment, the plate 16 (shown in FIG. 1-6) and decorative panel 12 (shown in FIG. 1-6) are integrated in a single-piece rigid decorative support panel 13. Decorative support panel 13 is formed of a rigid material (e.g., aluminum, titanium, stainless steel and other steel alloys, ceramic, high temperature plastic) that is capable of withstanding the back pressure forces created by the flow of water through the sprinkler head during operation in a high temperature environment. Sleeve 18*c* is attached to rigid decorative support panel 13 and provides a housing for the sprinkler head assembly 44 (not shown in FIG. 7). Rigid decorative support panel 13 fits into rectangular frame section 8 and helps to hold sprinkler head assembly 44 in place during operation by distributing some of the forces created by the flow of water through the sprinkler head to the ceiling frame 6. Additionally, the bottom surface (i.e., the surface exposed to the room) may be coated with a material to match the surface of other decorative panels 11 (as shown in FIG. 1).

Figure 8A:
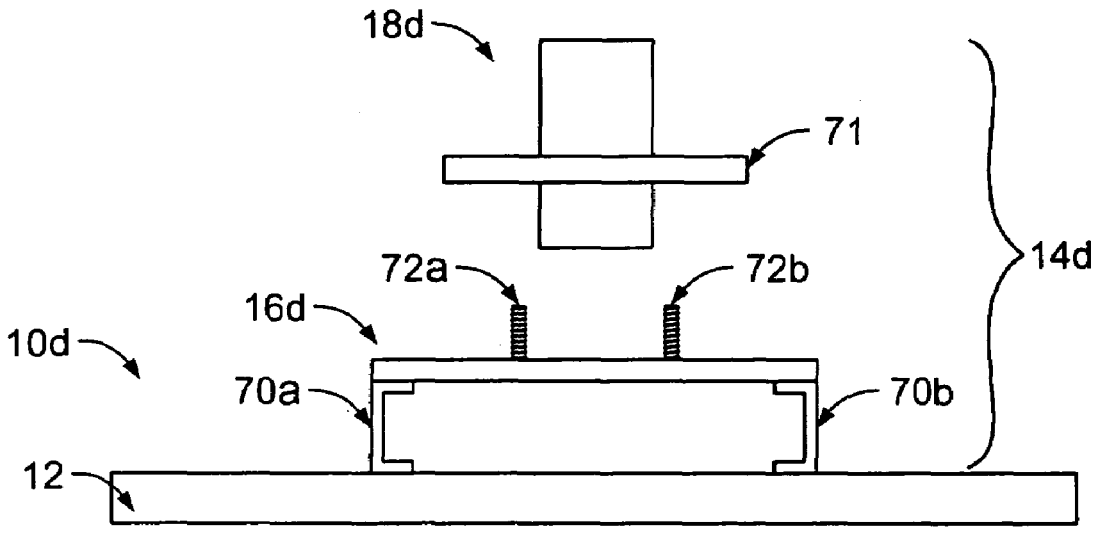
FIGS. 8A and 8B are a side and top view, respectively, of another decorative support panel having a pair of support brackets.
Figure 8B:
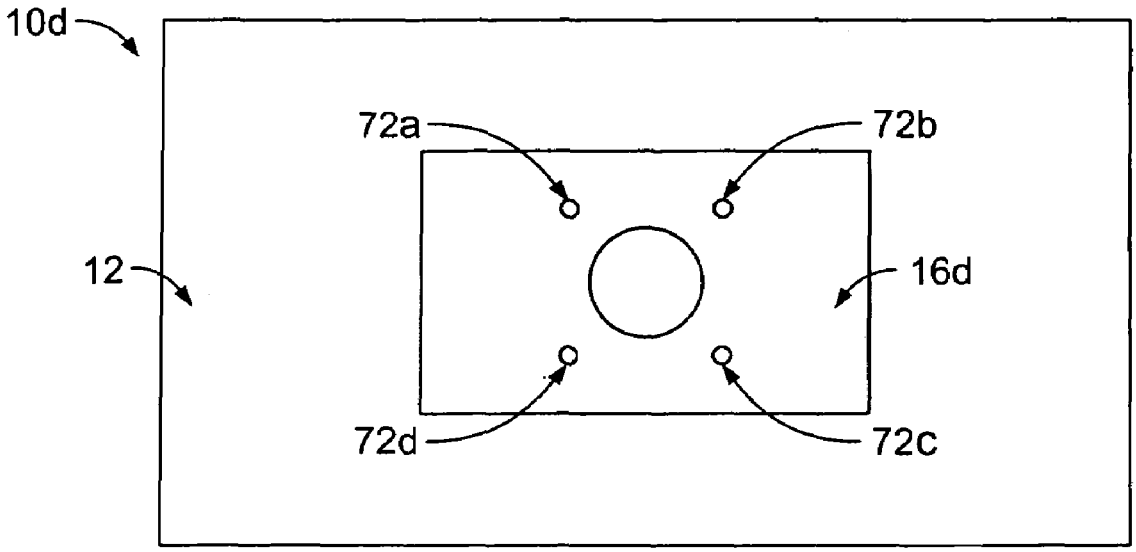

As shown in FIGS. 8A-8B, another decorative support panel 10*d* includes two brackets 70*a*-70*b* attached to decorative panel 12*d* and plate 16*d*. Additionally, plate 16*d* includes four bolts 72*a*-72*d* which attach sleeve 18*d* to the decorative support panel 10*d*. Sleeve 18*d* includes a plate 71 which has four holes (not shown) corresponding to the four bolts 72*a*-72*d* mounted on plate 16*d*. Four nuts (not shown) may be screwed onto the four bolts 72*a*-72*d* to secure sleeve 18*d* to plate 16*d*. In another embodiment, the plate 16*d* may include support legs which are inclined from plate 16*d* to the four corners of the decorative panel 12.

As shown in FIG. 9, another decorative support panel 10*e* is shown. In this embodiment, plate 16*e* is attached to decorative panel 12 and includes a sleeve 18*e*. Sleeve 18*e* is a sliding slot for receiving a sprinkler head assembly. During assembly of sprinkler system 2, sprinkler head assembly 44 is inserted through the larger hole 82 of sleeve 18*e* and then slid over to the smaller hole 84 of sleeve 18*e*. The diameter of the smaller hole 84 of sleeve 18*e* should be only slightly larger than the diameter of sprinkler head assembly in order to secure the sprinkler head assembly firmly to plate 16*e*.

Figure 10:
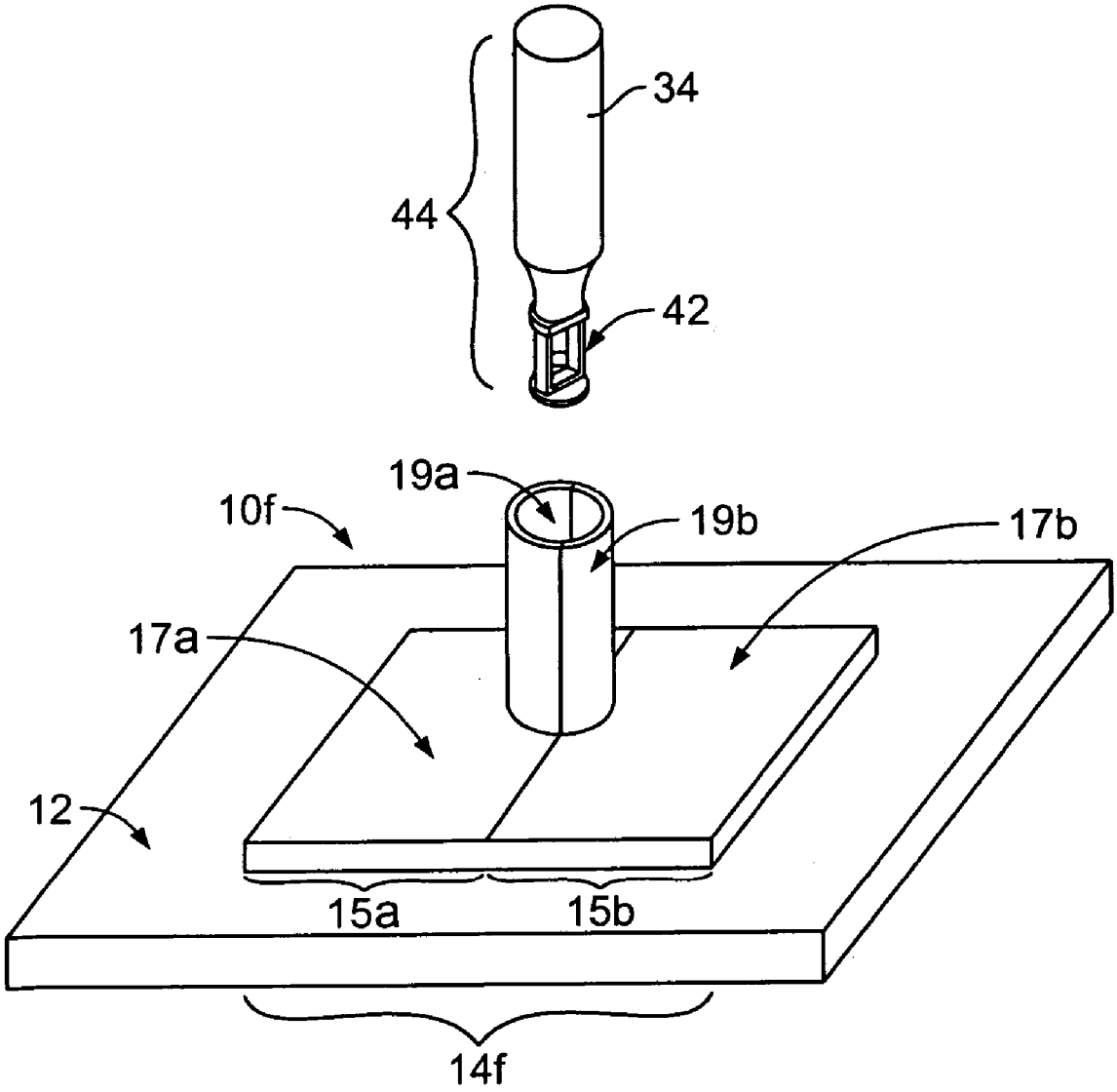
FIG. 10 is a perspective view of another sprinkler support panel having a split hub.

As shown in FIG. 10, a decorative support panel 10*f* with a split-hub 14*f* is shown. In this embodiment, hub 14*f* includes two pieces, 15*a* and 15*b*, which together provide a channel to receive sprinkler head assembly 44. One piece of the hub 15*a* includes a portion of the plate 17*a* and the sleeve 19*a*. The other piece of the hub 15*b* includes a second portion of the plate 17*b* and sleeve 19*b*. The two pieces of the hub 15*a*, 15*b* are removably attached to each other by bolts (not shown), screws, pins, clips or other commonly known methods.

Figure 11:
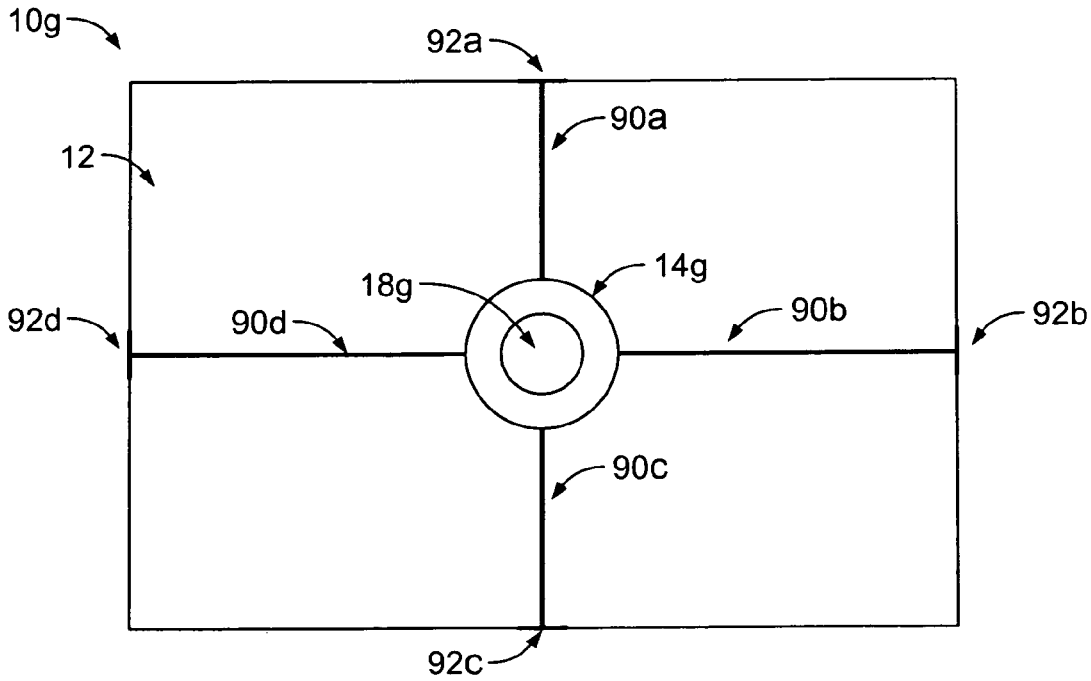
FIG. 11 is a top view of another sprinkler support panel having a ring-shaped plate and four support legs.

As shown in FIG. 11, another decorative support panel 10*g* with a ring-shaped hub 14*g* is shown. In this embodiment, hub 14*g* is ring-shaped and is attached to decorative panel 12. The opening of hub 14*g* defines the sleeve 18*g* and is configured to receive a sprinkler assembly 44 (not shown in FIG. 11). Hub 14*g* is also supported by four legs 90*a*-90*d*, which extend from hub 14*g* to the center of each of the four edges of the decorative panel 12. Each of the four legs 90*a*-90*d*, include a foot 92*a*-92*d* attached at the end of each leg. When decorative support panel 10*g* is placed in a rectangular frame section 8 of the ceiling frame 6 (as shown in FIG. 1), the four feet 92*a*-92*d* attached at the end of each leg 90*a*-90*d* engage the ceiling frame 6 and thus provide additional support of the sprinkler head assembly. Additionally, the four legs 90*a*-90*d* may be further secured to the ceiling frame 6 with clips, pins, bolts, nails, screws or other commonly known methods.

A number of embodiments of the invention have been described. Nevertheless, it will be understood that various modifications may be made without departing from the spirit and scope of the invention. For example, the previous embodiments have described a sprinkler support system housed in a ceiling. However, a sprinkler support system may be housed in a wall or floor having an array of panels supported by a frame.

Accordingly, other embodiments are within the scope of the following claims.

What is claimed is:

1. An apparatus for positioning and supporting a sprinkler head coupled to a flexible conduit in a suspended ceiling, the apparatus comprising:

a hub configured to receive the sprinkler head and flexible conduit, the hub including:

a plate;

a sleeve defining an opening extending through a surface of the plate, the sleeve configured to receive the sprinkler head through the opening;

a panel; and a T-bar grid arranged within the suspended ceiling;

wherein the panel is attached to the hub and attached to the T-bar grid, the panel for supporting the sprinkler head and flexible conduit, the panel having a hole sized and shaped to allow the sprinkler head to extend therethrough.

2. The apparatus of claim 1 wherein the hub is removably attached to the panel.

3. The apparatus of claim 2 wherein the hub is attached to the panel with a fastener.

4. The apparatus of claim 1 wherein the hub is laminated to the panel.

5. The apparatus of claim 1 wherein the hub is at least partially integrated within the panel.

6. The apparatus of claim 1, wherein the panel has a length L and a width W and the plate has a length and width substantially equal to L and W, respectively.

7. The apparatus of claim 1, wherein the plate is in the shape of a ring having a thickness T and an inner diameter R1 and an outer diameter R2 and the sleeve is defined by the opening of the plate.

8. The apparatus of claim 1, wherein the panel has a certain rigidity characteristic and the plate has a certain rigidity characteristic greater than the rigidity characteristic of the panel.

9. The apparatus of claim 8, wherein the panel is formed at least partially from PVC and the plate is formed at least partially from stainless steel.

10. The apparatus of claim 1 wherein the plate has a hole extending through the surface and the sleeve is defined by a hole in the plate.

11. The apparatus of claim 1 wherein the sleeve is attached to the plate.

12. The apparatus of claim 11 wherein the sleeve is removably attached to the plate.

13. The apparatus of claim 1 wherein the plate includes a plurality of sleeves, the sleeves being configured to receive one sprinkler head.

14. The apparatus of claim 1 wherein the sleeve is telescopic being configured to open to receive the sprinkler head and close to secure the sprinkler head in place.

15. The apparatus of claim 1 further comprising an attachment member having a first end attached to the plate and a second end configured to engage the T-bar grid.

16. The apparatus of claim 15 wherein the second end of the attachment member is adapted to be attached to the T-bar grid by a fastening device selected from a group consisting of a nail, a clip, a bolt, a screw, a tab connection, or a slot connection.

17. The apparatus of claim 15, wherein the attachment member is at least partially integrated within the decorative panel.

18. The apparatus of claim 15 wherein the attachment member further comprises a foot attached to its second end and configured to engage T-bar grid.

19. The apparatus of claim 15 wherein the panel is rectangular in shape and the attachment member extends to the corner of the panel.

20. The apparatus of claim 15 wherein the attachment member is angled relative to the plate.

21. The apparatus of claim 15 further comprising a plurality of attachment members, each having a first end attached to the plate and a second end configured to engage T-bar mid.

22. The apparatus of claim 21 wherein the plurality of attachment members are in the form of legs.

23. The apparatus of claim 1 wherein the plate comprises first and second plate sections, the sleeve comprises a first sleeve section attached to the first plate section, the first plate section being removably attached to second plate section.

24. The apparatus of claim 1, further comprising: a first bracket having a first and second surface, the first surface of the first bracket attached to the plate and the second surface of the first bracket attached to the panel.

25. The apparatus of claim 24, further comprising a second bracket having a first and second surface, the first surface of the second bracket attached the plate and the second surface of the second bracket attached to the panel.

26. The apparatus of claim 25, wherein the first and second brackets are removably attached to the panel.

27. The apparatus of claim 25 wherein the first and second brackets are removably attached to the plate.

28. The apparatus of claim 1 further comprising a flexible sprinkler assembly comprising: the flexible conduit; a fitting attached to the flexible conduit; and the sprinkler head attached to the fitting.

29. The apparatus of claim 28 wherein the flexible sprinkler assembly is releasably attached to the sleeve.

30. The apparatus of claim 29 wherein the plate defines a channel sized to slidably receive the sprinkler head assembly.

31. The apparatus of claim 28 wherein the sleeve is integral to the sprinkler head.

32. The apparatus of claim 1 further comprising a rod having a first end attached to the hub and a second end adapted to be attached to a support structure in a ceiling.

33. An apparatus for positioning and supporting a sprinkler head coupled to a flexible conduit in a suspended ceiling, the apparatus comprising:

a T-bar grid arranged within the suspended ceiling;

a panel removably attached to T-bar grid and having an exterior surface exposed to a room, the panel configured to support the sprinkler head and flexible conduit; and a sleeve defining an opening extending through a surface of the panel, the sleeve configured to receive the sprinkler head through the opening.

34. The apparatus of claim 33 wherein the sleeve is defined by a hole in the panel.

35. The apparatus of claim 33 wherein the sleeve is attached to the panel.

36. The apparatus of claim 35 wherein the surface of the panel exposed to the room is coated with a material.

37. The apparatus of claim 33 further comprising a flexible sprinkler assembly comprising: the flexible conduit; a fitting attached to the flexible conduit; and the sprinkler head attached to the fitting.

38. The apparatus of claim 37 wherein the flexible sprinkler assembly is removably attached to the sleeve.

39. An apparatus for positioning and supporting a sprinkler head coupled to a flexible conduit in a suspended ceiling, the apparatus comprising:

a plate;

a decorative panel; and a T-bar grid arranged within the suspended ceiling;

wherein the panel is attached to the plate and attached to the T-bar grid, the decorative panel for supporting the sprinkler head and flexible conduit, the decorative panel having an exterior surface exposed to a room and having a hole sized and shaped to receive the sprinkler head therethrough.

40. The apparatus of claim 39 wherein the plate is at least partially integrated within the decorative panel.

41. The apparatus of claim 39 wherein the plate is laminated to the decorative panel.

42. The apparatus of claim 39 wherein the decorative panel is removably attached to the plate.

43. The apparatus of claim 39 wherein the decorative panel has a length L and width W and the plate has a length and width substantially equal to L and W respectively.

44. The apparatus of claim 39 wherein the plate is in the shape of a ring having an thickness T and inner diameter R1 and an outer diameter R2.

45. The apparatus of claim 39 wherein the plate is formed of stainless steel.

46. The apparatus of claim 39 wherein the plate comprises first and second plate sections, the first plate section being removably attached to second plate section.

47. The apparatus of claim 39 wherein the plate has a hole sized and shaped to the receive the sprinkler head therethrough.

48. The apparatus of claim 39 further comprising: a sleeve attached to the plate and defining an opening extending through a surface of the plate, the sleeve configured to receive the sprinkler head through the opening.

49. The apparatus of claim 48 wherein the sleeve is removably attached to the plate.

50. The apparatus of claim 48 wherein the sleeve is integral to the sprinkler head.

51. The apparatus as in any one of claims 1, 33 and 48 wherein the sleeve is a fitting.

52. The apparatus of claim 51 wherein the fitting is a reduced fitting.

53. The apparatus of claim 52 wherein the sprinkler head is attached to the reduced fitting.

54. The apparatus of claim 53 wherein the flexible conduit is attached to the reduced fitting.

55. The apparatus of claim 39 further comprising a flexible sprinkler assembly comprising: the flexible conduit; a fitting attached to the flexible conduit; and the sprinkler head attached to the fitting.

56. The apparatus of claim 55 wherein the flexible sprinkler assembly is removably attached to the panel.

57. The apparatus of claim 39 further comprising an attachment member having a first end attached to the plate and a second end configured to engage the T-bar grid.

58. The apparatus of claim 57 wherein the attachment member is at least partially integrated within the decorative panel.

59. The apparatus of claim 58 wherein the second end of the attachment member is adapted to be attached to the T-bar grid by a fastening device selected from a group consisting of a nail, a clip, a bolt, a screw, a tab connection, or a slot connection.

60. The apparatus of claim 57 further comprising a plurality of attachment members, each having a first end attached to the plate and a second end configured to engage the T-bar grid.

61. The apparatus as in any one of claims 1, 33 and 39 wherein the panel is formed of a material capable of distributing forces from the sprinkler bead and flexible conduit, during operation, to the T-bar grid.

62. The apparatus as in any one of claims 1, 33 and 39 wherein the panel is formed of a material capable of withstanding back pressure forces associated with the flow of water through the sprinkler head during operation.

63. A method of positioning a fire-protection sprinkler head coupled to a flexible conduit in a in a suspended ceiling, the method comprising:

providing a plate;

arranging a T-bar grid within the suspended ceiling; and attaching a decorative panel to the T-bar grid and to the plate, the decorative panel for supporting the sprinkler head and flexible conduit, the decorative panel having an exterior surface exposed to a room, the panel having a hole sized and shaped to allow the sprinkler head to extend therethrough.

64. The method of claim 63 further comprising providing a sleeve defining an opening extending through a surface of the plate, the sleeve configured to receive the fire-protection sprinkler head; and attaching the sleeve to the plate.

65. The method of claim 64, further comprising: providing a flexible conduit having a fitting and attaching the sprinkler head to the fitting; and positioning the sprinkler head in the sleeve.

66. The method of claim 65 further comprising adjusting the height of the sprinkler head relative to the opening.

67. The method of claim 66 further comprising securing the sprinkler head to the sleeve.

68. The method of claim 67 further comprising connecting a second end of the flexible conduit to a supply pipe.

69. The method of claim 63 further comprising forming the decorative panel from a material capable of withstanding back pressure forces associated with the flow of water through the sprinkler head during operation.

70. The method of claim 63 further comprising forming the decorative panel from a material capable of distributing forces from the sprinkler head and flexible conduit, during operation, to the T-bar grid.

71. A system comprising:

a flexible conduit;

a sprinkler head to receive the flexible conduit;

a hub configured to receive the sprinkler head and flexible conduit, the hub including:

a plate;

a sleeve defining an opening extending through a surface of the plate, the sleeve configured to receive the sprinkler head through the opening;

a panel; and a T-bar grid arranged within a suspended ceiling;

wherein the panel is attached the hub and attached to the T-bar grid, thereby supporting the sprinkler head and flexible conduit.

* * * * *